US005228291A

United States Patent [19]

Meyering

[11] Patent Number: 5,228,291

[45] Date of Patent: Jul. 20, 1993

[54] MOTOR WITH ROTATING MASS INDUCED VIBRATION DRIVING MEANS

[76] Inventor: Ralph A. Meyering, 1369 Somerset, Grosse Pointe Park, Mich. 48230

[21] Appl. No.: 778,703

[22] Filed: Oct. 18, 1991

Related U.S. Application Data

[63] Continuation-in-part of Ser. No. 505,133, Apr. 5, 1990, abandoned.

[51] Int. Cl.[5] ..... F15B 7/00; F04B 19/00

[52] U.S. Cl. ..... 60/571; 60/545; 417/211

[58] Field of Search ..... 60/532, 533, 571, 581, 60/594, 545; 417/211

[56] References Cited

U.S. PATENT DOCUMENTS

| | | | |
|---|---|---|---|
| 1,601,370 | 9/1926 | Oden | 92/138 X |
| 2,839,237 | 6/1958 | Dolz | 417/211 |
| 3,198,425 | 8/1965 | Robertson | 417/211 |
| 3,395,536 | 8/1968 | Foster | 60/532 |
| 3,511,050 | 5/1970 | Taberner | 60/532 |
| 3,657,972 | 4/1972 | Strebel et al. | 92/138 X |
| 3,697,196 | 10/1972 | Moisdon | 417/211 |
| 4,328,670 | 5/1982 | McLean | 60/594 X |
| 4,406,587 | 9/1983 | Perry | 417/211 |
| 4,416,589 | 11/1983 | Perry | 417/211 |

FOREIGN PATENT DOCUMENTS

| | | | |
|---|---|---|---|
| 824601 | 12/1951 | Fed. Rep. of Germany | 60/571 |
| 971491 | 2/1959 | Fed. Rep. of Germany | 60/571 |
| 1187440 | 9/1959 | France | 60/571 |
| 284012 | 10/1952 | Switzerland | 60/581 |

OTHER PUBLICATIONS

IBM technical disclosure bulletin, K. Lindner, vol. 6 No. 6, Nov. 1963.

*Primary Examiner*—Edward K. Look
*Assistant Examiner*—John Ryznic
*Attorney, Agent, or Firm*—Barnes, Kisselle, Raisch, Choate, Whittemore & Hulbert

[57] ABSTRACT

A novel motor and method for converting rotary input motion to axial reciprocating motion of an output shaft in which input work and energy are transferred by creating unbalanced reaction forces with a motor driven unbalanced rotating mass as it acts on a pair of first pistons in direct communication with hydraulic fluid. The reaction forces created by the spinning unbalanced mass are converted to axial reciprocating motion by constraining the motion of the mass drive shaft, the supporting structure and the first pistons. A pair of second pistons, being integral with an output shaft, transfers oscillating pulses from the first pistons to a common output shaft where it can be applied to do work on an external system. Variation of motor speed provides a method of tuning the angular velocity of the unbalanced mass to match the system's nature frequency or multiples of that, thereby enhancing the system's vibration and constrained axial displacement, and resulting in enhanced input to the hydraulic first piston assemblies and output to the output shaft.

4 Claims, 2 Drawing Sheets

MOTOR WITH ROTATING MASS INDUCED VIBRATION DRIVING MEANS

This is a continuation-in-part of copending application Ser. No. 07/505,133, filed on Apr. 5, 1990, abandoned.

FIELD OF THE INVENTION

This invention relates to a power transmission incorporating a fluid drive system, method and apparatus for converting rotary input motion to reciprocating output motion by producing and transferring pressure oscillations in a hydraulic fluid closed system.

BACKGROUND OF THE INVENTION

Previously known ways of creating and transferring pressure pulses through hydraulic fluid were disclosed by Taberner in U.S. Pat. No. 3,511,050, and in Russian Patents No. 120,128 and 1,242,205/23-26. Taberner discloses, in the drawings, an eccentric cam driving a piston with rectilinear motion to create a source of fluid pressure oscillations. The former Russian patent discloses a device for transferring the energy of a hydraulic shock to a piston functioning as the working hydraulic cylinder of a hammer. Hydraulic elastic shock waves are produced in a pipe which communicates with the hydraulic cylinder. However, the former Russian patent does not teach a new way to create the hydraulic shock wave. The later Russian patent discloses a device for creating stable pulsation utilizing a piston and cylinder arrangement driving an air cushion through a pressure line and into a liquid, thereby transferring the pulsed energy into the liquid. The air cushion functions to stabilize the pulsation of the liquid component. The piston is driven by a spinning wheel and connecting rod crank arm utilizing a variable length connecting rod to drive the piston. Although the combined wheel and crank assembly spin with a slight rotational mass imbalance due to the attached offset mass of the crank arm, the relatively small offset mass distribution of the wheel and crank arm will not produce significant vibratory imbalance and vibration displacement. In fact, application of machine design techniques to rotating objects produces balanced rotating objects which minimize or eliminate vibration. This invention proposes the opposite, to intentionally unbalance the mass and create large vibrations, then harness them into unidirectional oscillations with a rectilinear guideway, thereby creating strong vibrations and displacements at the mass by tuning the system to its natural excitation frequency or multiples of that.

The invention comprises a motor mounted on a movable carriage and which drives an unbalanced rotating mass, thereby creating inertial forces from the rotational imbalance of the mass which tends to shake the mass, motor and the associated mounting carriage due to the dynamic rotational imbalance. The carriage is constrained by a housing or body to shake about one translational axis, thereby imparting rectilinear motion to the carriage and a pair of first pistons rigidly fixed thereto. The first pistons are in direct communication with corresponding housing chambers completely filled with hydraulic fluid and, in response to push-pull action of the first pistons on the contained fluid, the drive fluid in turn acts upon, and produces rectilinear reciprocating motion of, a pair of second pistons and accompanying output shaft which are likewise fluid coupled to the associated housing chambers.

Objects, features and advantages of this invention are to provide a tunable apparatus and method for producing pressure oscillations in hydraulic fluid using the reaction forces produced by a rotating unbalanced mass to drive a pair of first pistons, and being in direct communication with hydraulic fluid, to transfer the oscillating pressure pulses to a pair of second pistons and correspondingly, a common output shaft, thereby acting on and doing work on an external system, utilizing the inertia forces created by the unbalanced rotating mass.

BRIEF DESCRIPTION OF THE DRAWINGS

These and other objects, features and advantages of this invention will be apparent from the following detailed description, claims and accompanying drawings in which:

DETAILED DESCRIPTION OF PREFERRED EMBODIMENTS

Figure 1:
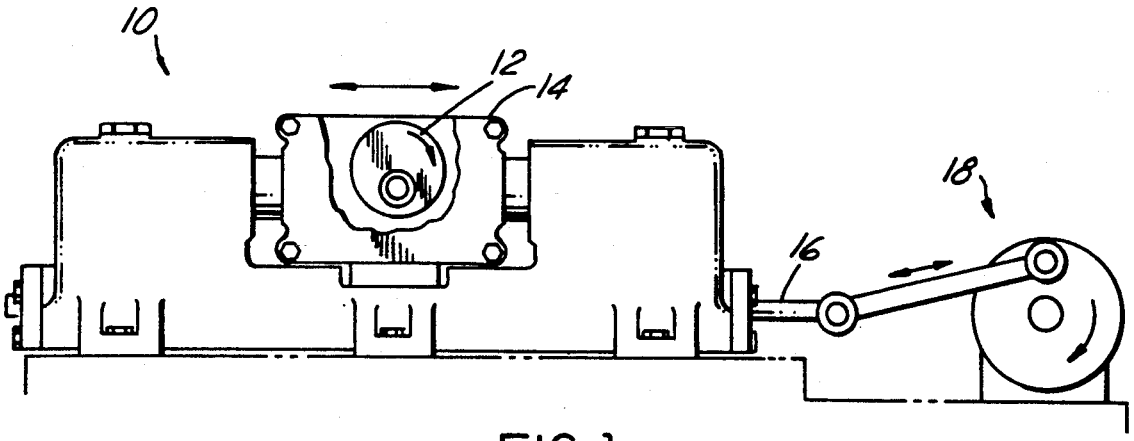
FIG. 1 is a side elevational view of the weight and expandible chamber motor producing output work on a wheel and crank assembly, with a portion broken away to illustrate the unbalanced mass.
Figure 2:
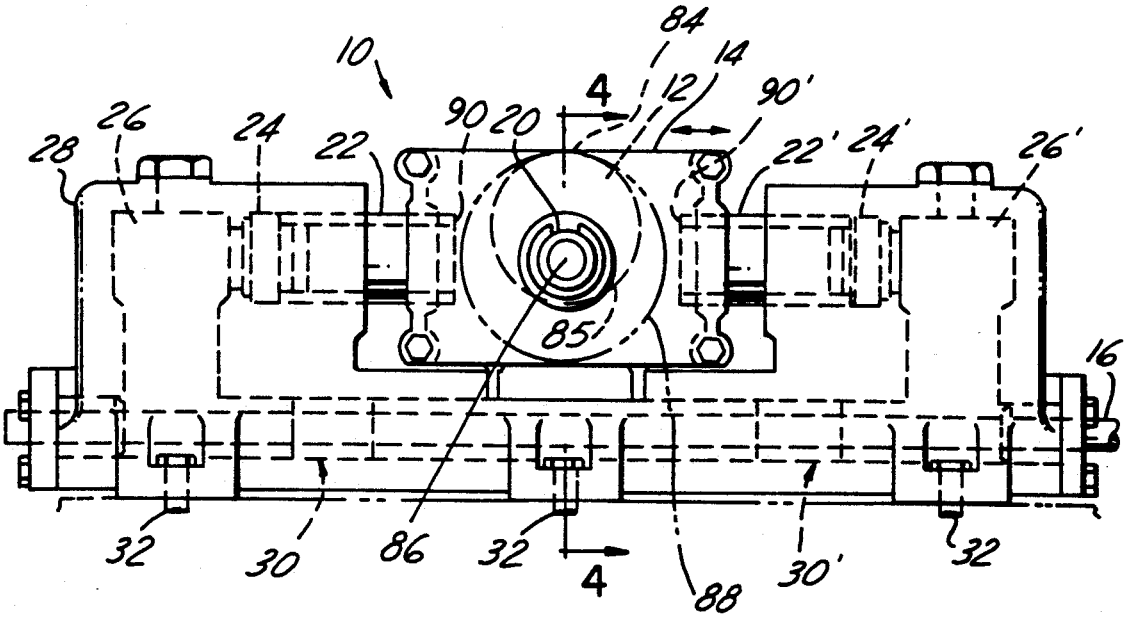
FIG. 2 is a side view of the weight and expandible chamber motor showing the unbalanced mass, pistons and hydraulic fluid reservoir in hidden lines.

Referring in more detail to the drawings, FIG. 1 illustrates an exemplary but presently preferred embodiment of a weight and expandible chamber motor 10 of the invention as it applies output work to an external system. An unbalanced rotating mass 12 in the form of a thick cylindrical disc is mounted inside a carriage 14, whereby work from an output shaft 16 is transferred to an external system consisting of a crank and wheel 18. FIG. 2 is a side view illustrating the motor 10, utilizing the disc 12 spinning about a center of rotation defined by the rotational axis of a drive shaft 20 upon which mass 12 is fixedly mounted for rotation therewith, the center of mass of disc 12 being offset from the rotational axis of shaft 20 to thereby produce an imbalance induced vibration. The mass 12 is centrally positioned in the carriage 14 which is attached to a pair of coaxial first pistons 22 and 22'. Pistons 22 and 22' are respectively reciprocably seated in cylinder bores 24 and 24' and are in direct communication with hydraulic fluid in respectively associated hydraulic fluid reservoirs 26 and 26' which are contained in the body of the expandible chamber motor 28. The hydraulic fluid is also in opposite direct communication with a pair of second pistons 30 and 30' which are fixedly mounted on the common output shaft 16 capable of performing work on an external source. The entire motor assembly 10 is secured by fasteners 32 to a mounting surface of a suitable rigid supporting structure.

Figure 3:
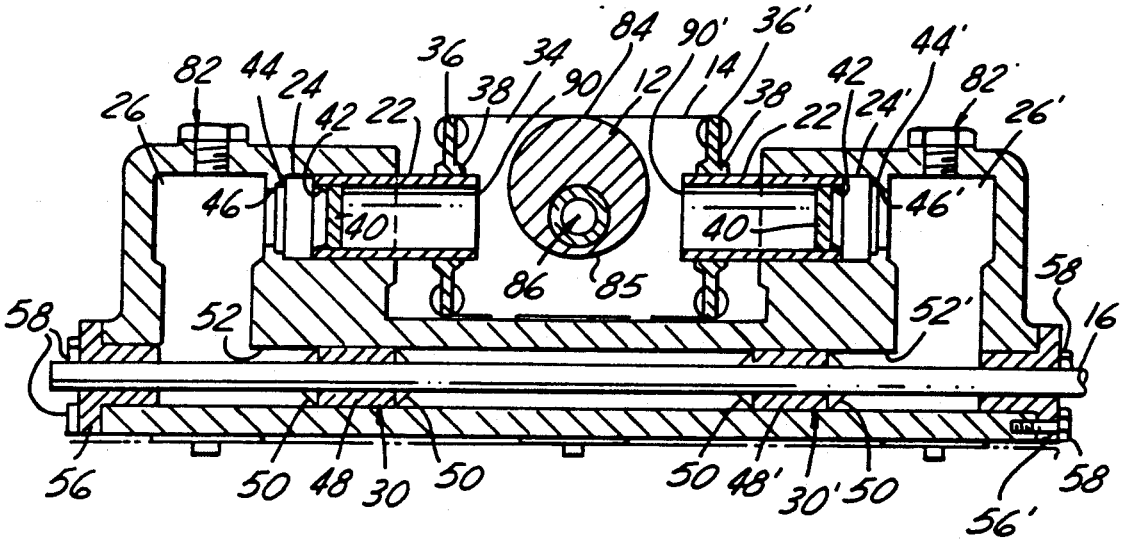
FIG. 3 is a cross-sectional view down the axial midplane of FIG. and taken in the section line 3—3 of FIG. 4.

In accordance with the preferred embodiment of this invention, FIG. 3 shows a longitudinal sectional view of the motor in FIG. 2 through the axial center line of the pistons 22 and 30. The carriage 14 is constructed from two side panels 34 and 34' and two end panels 36 and 36'. Both end panels 36, 36' receive first pistons 22, 22' through an associated clearance hole in each panel to which the pistons are affixed as by welding at 38. Both first pistons 22, 22' are constructed from a hollow tube with a disc 40 inserted into the tube and welded at 42 at the piston end in communication with the hydraulic fluid. The cylinder bore receiving each first piston is made by first casting into the body of the expandible chamber motor with an undersized core having diameter counterbore 44, 44' and then each cylinder is finish bored to the required final diameter of bores 24, 24'. Between each cylinder counterbore 44, 44' and fluid reservoir 26, 26' is an orifice 46, 46' through which the hydraulic fluid passes as it moves between the first cylinder recess 44, 44' and fluid reservoir 26, 26'.

Both second pistons 30 and 30' are constructed on common output shaft 16 and comprise collars 48, 48' closely fitted about the outer diameter of shaft 16 and attached thereto with welds 50. The collars form the effective working surface area of the second pistons in direct communication with the hydraulic fluid. Likewise, the bores 52, 52' receiving the second pistons 30 and 30' are initially cast into cylinder recesses with an undersize diameter and then bored to the required dimension to receive the second pistons. At opposite ends of the shaft 16 are end collar caps 56, 56' in close fitting contact with the shaft and the expandible chamber motor. Caps 56, 56' provide sealed guiding surfaces for shaft 16 as it is reciprocably oscillated by the second pistons 30, 30' in response to their communication with pulsating hydraulic fluid in chambers 26, 26' as the same is driven by the first pistons 22, 22'. The end caps 56, 56' are removably attached to the motor assembly 10 with fasteners 58.

Figure 4:
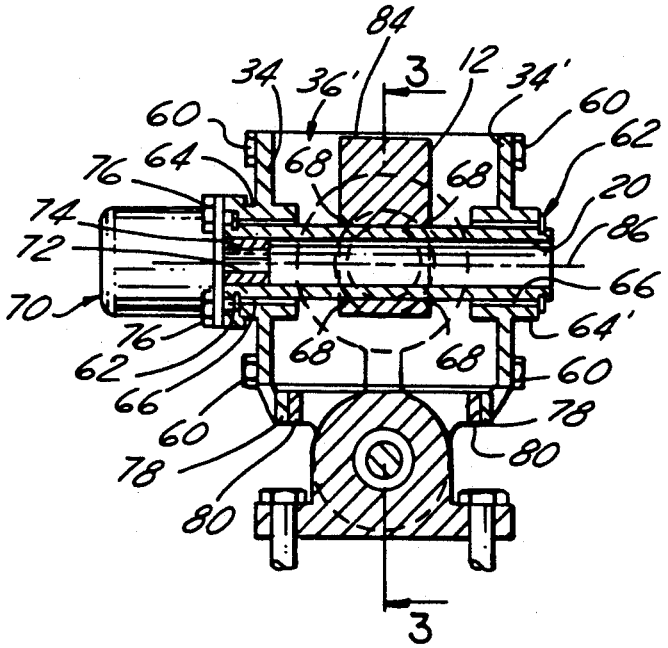
FIG. 4 is a cross-sectional view taken on the section 4—4 of FIGS. 2 and 3.

As shown in FIG. 4, the side panels 34, 34' of carriage 14 are removably attached to the end panels 36, 36' with fasteners 60. The shaft 20, which is preferably constructed from a hollow tube, is held between the side panels 34, 34' by snap rings 62 on the shaft 20 adjacent and external to each side panel 34, 34'. Additionally, each side panel 34, 34' has a cylindrical hub portion 64, 64' through which the shaft 20 is journaled, and the snap rings 60 abut. The inner periphery of each hub 64, 64' forms a bushing surface 66 for shaft 20. The shaft 20 and disc 12 are joined by welds 68 and as the shaft 20 passes through a bore in disc 12 offset from the center of mass of disc 12. An input motor 70 is attached to shaft 20 by inserting motor drive shaft 72 into the inner periphery of shaft 20 and keying the same thereto at 74. The casing of input motor 70 is fixedly attached to the outer surface of one side panel 34 with fasteners 76. The eccentric disc 12 and carriage 14 are restrained from rotating about the central axis of the first pistons 22, 22' by the outer linear guide faces of gibs 78 slidably abutting with the inner linear guide faces of guides 80. Threaded plugs 82 provide a means for replenishing hydraulic fluid reservoirs 26, 26' due to leakage of hydraulic fluid over time. Suitable fluid seals comprising rings, packing or seals can be provided on pistons 22, 22', 30 and 30', end collar caps 56, 56', and threaded plugs 82.

In operation, the vibrations generated by an unbalanced spinning mass 12 driven by motor 70 and mounted in a carriage 14 and fixed to a pair of first pistons 22, 22' produces axial reciprocating motion of mass 12, carriage 14, motor 70 and pistons 22, 22'. The pistons 22, 22' as thus reciprocably driven act on hydraulic fluid in a pair of hydraulic chambers 26, 26' and thereby create oppositely phased pressure pulses to force the associated contained fluid to drivingly act in a push-pull mode on a pair of second pistons 30, 30' mounted in common on an output shaft 16, thereby causing the transfer of mechanical energy to an external device 18. Thus, electrical input energy is converted to the shaking motion of the unbalanced mass 12 and the first pistons 22, 22' fixedly coupled thereto, and transferred through hydraulic fluid to impart reciprocation to the second pistons 30, 30' and an associated output shaft 16, thereby enabling the system to produce output work on an external device 18. One possible embodiment utilizes this weight and expandible chamber motor 10 to impart energy to a flywheel for driving an electric vehicle by utilizing a small electric motor power source to drive the unbalanced mass 12, and connecting the reciprocating output shaft 16 to a flywheel and crank arm to store kinetic energy, and finally to transfer the energy through a clutch and transmission to drive wheels or to transfer the energy through a generator or attenuator to a motor or motors and two drive wheels.

From the foregoing description, it will now be understood that, pursuant to this invention, a large mass 12 is driven in rotation about an axis offset from its center of gravity to induce a large scale vibratory imbalance created from unbalanced inertial forces acting about the axis of rotation of the mass 12, thereby tending to induce shaking and displacement of the mass 12 about its axis of rotation. The mass 12 is driven by an auxiliary motor 70 and mounted inside a carriage 14 which in turn is attached to a pair of parallel first piston assemblies 22, 22'. Each first piston assembly 22, 22' is in communication with hydraulic fluid contained in an accompanying fluid reservoir 26, 26' and in oppositely faced communication with a second piston 30, 30', the pair of second pistons 30, 30' being formed on a common output shaft 16 which receives work produced by the axially constrained motion of the spinning unbalanced mass 12, resulting from the unbalanced inertial forces acting about its axis of rotation. By tuning the angular velocity of the vibrating mass 12 to match the excitation frequency of the total system, which includes output work being done by the output shaft 16 on some external device 18, the vibrating imbalance can be maximized for a given amount of energy being input into the system thereby exciting the natural frequency or multiples of that of the system and producing maximum displacements and vibrations about the pair of first pistons 22, 22'. Preferably, the rotating mass 12 is cylindrical and disc-shaped, and is heavy, and the motor 70, carriage 14 and first piston assemblies 22, 22' are light.

To convert the oscillatory motion of the rotating unbalanced mass 12 into rectilinear motion along the pair of first piston assemblies 22, 22', the mass 12 is mounted inside a carriage assembly 14 by journaling the rotating shaft 22 to the body of the carriage 14. The driving motor 70 is fixed to the carriage 14 with the carriage assembly 14 rigidly welded to both first piston assemblies 22, 22', and the entire rigid assembly of first pistons 22, 22', mass 12 and car 14 is constrained to move in axial translation parallel to the axes of the pair of first piston assemblies 22, 22' by the accurate fit of each piston 22, 22' inside a bored cylinder 24, 24' which accepts the piston inside the body of its hydraulic fluid reservoir 26, 26'. The resulting rectilinear motion of each piston 22, 22' in the bored cylinder 24, 24', inside the body of the housing 28, is further constrained from rotational motion about the axes of the first piston assemblies 22, 22' by providing for gibs 78 on the carriage parallel and off the axes of the first piston assemblies 22, 22' and contacting complimentary surfaces 80 adjacent the body of the hydraulic fluid reservoir about the second piston assemblies and output shaft. Preferably, the first piston assemblies 22, 22' align axially with each piston affixed to an end of the carriage opposite the other first piston.

To provide for a pair of second piston reaction surfaces on the output shaft, the shaft 16 passes through the lower body of the housing 28, passing through both hydraulic fluid reservoirs 26, 26', and is fitted with a pair of cylindrical collars 48, 48' about the shaft 16 thereby exposing a reaction surface in communication with the fluid pressure of each reservoir. The outer diameter of each collar 48, 48' precisely fits into the bore 52, 52' in the body of each fluid reservoir 26, 26' thereby sealingly allowing translation of the collar 48, 48' and shaft assembly 16 inside the housing while containing the hydraulic fluid in each chamber. Both ends of the output shaft exit the housing 28 through an end cap 56, 56' which precisely fits around the shaft 16 allowing translation of the shaft 16 through the cap 56, 56' and sealingly containing the hydraulic fluid in each reservoir 26, 26' and forming a seat and guide way that sealingly attaches to the body of each hydraulic fluid reservoir 26, 26'.

Preferably, the exposed effective surface area on each first piston 22, 22' is greater than the exposed effective surface area on each second piston 30, 30' as formed by the collar 48, 48' about the output shaft 16, and more specifically it is preferred that the exposed effective surface area of each first piston 22, 22' be several times greater than the exposed effective surface area of each second piston 30, 30'. The ratio of first piston surface area to second piston surface area is inversely related to the distance traveled by a first piston 22, 22' relative to a second piston 30, 30' as they are in direct communication with their adjoining hydraulic fluid. Therefore, a two to one ratio of surface areas from piston one 22, 22' to piston two 30, 30' will produce a one to two ratio of displacements assuming an inelastic hydraulic fluid is used.

From the foregoing description and the appended drawings referred to therein, it now will be readily understood by those skilled in the art that the power transmission system and mechanism of the invention contemplates a non-contact mode of operation with respect to the driving forces generated by the rotating mass 12 and the resultant reciprocating motion imparted to the associated pistons 22 and 22'. In particular, and referring once again to FIGS. 2 and 3, it will be seen that the path of travel of that portion 84 of the surface of the outer periphery 85 of mass 12 most remote from its axis of rotation 86 moves in a circular path of travel 88 indicated by the broken line in FIG. 2. This path of travel 88 is spaced clear of the inner ends 90 and 90' of pistons 22 and 22' respectively, it being recalled that the inner ends of the pistons are held fixed in a spaced apart relation by their welded attachment 38 to the respective end plates 36 and 36' of carriage 14. Since there is no contact between the periphery of mass 12 and any other surface in the mechanism, and in particular with the spaced apart ends 90 and 90' of pistons 22 and 22', there is no frictional drag exerted on the periphery of mass 12, in contradistinction to the operation of various prior art eccentric cam driving systems, utilized in certain piston-type pumping mechanisms. Likewise there is no wear produced on the periphery of mass 12 because of its contact-free mode of operation. The aforementioned tuning of the angular velocity of the vibrating mass 12 to match the natural frequency of the total system likewise is not impaired by any frictional or drag forces on the periphery 85 due to the contact-free nature of the spinning-mass motion which creates the large scale vibratory imbalance resulting from the unbalanced inertial forces acting about the axis of rotation 86 of mass 12, i.e., centrifugal forces caused by the rotation of the off-center or eccentric center of mass (sometimes also referred to as "center of gravity") of mass 12 about its axis of rotation 86.

I claim:

1. An expandible chamber motor for producing pressure oscillations in hydraulic fluid by converting rotary input motion from an unbalanced rotating mass to reciprocating motion of an output shaft of the motor comprising in combination:

a) a stationary housing having a pair of hydraulic chamber means provided therein defining in each a first cylinder chamber, a second cylinder chamber and means for communicating hydraulic fluid between said chambers, b) a pair of first piston assemblies including in each a first piston reciprocally mounted in said first cylinder for varying the volume of said first chamber, a carriage operably connected to and between each of the first pistons externally of said housing, a rotatable mass on said carriage mounted for rotation about an axis perpendicular to the direction of reciprocation of said first pistons and having its center of mass offset relative to the axis of rotation of said mass body, c) means for rotatably driving said mass body about said axis of rotation thereof to create unbalanced inertia forces about the rotation axis of the unbalanced mass and constraining motion about an axis parallel to the axes of the first pistons, said unbalanced inertia forces of said mass body thereby imparting rectilinear reciprocating motion to said pistons in said stationary housing, and d) a pair of second pistons reciprocally mounted in each second cylinder of said housing and being joined to a common output shaft and driven by the varying volume of both second chambers in reciprocal relationship with the reciprocation of said pistons in said first chambers, said pistons being in direct communication with the hydraulic fluid between said chambers, e) and wherein said rotatable mass is constructed and arranged to have an outer periphery with a portion thereof most remote from said axis of rotation moveable in a circular path of travel spaced clear of any other surfaces in the motor such that said rotatable mass rotates freely without contacting any of such surfaces.

2. The expandible chamber motor of claim 1 wherein said first cylinder pistons and carriage are supported for rectilinear motion by precision bored cylinders in the stationary housing having a diameter complementary to the outer diameter of each first piston to thereby provide a smooth axial sliding fit between the pistons and housing.

3. The expandible chamber motor of claim 1 whereby a pair of anti-twist bearing surfaces extend from the carriage and create parallel abutment surfaces alongside complementary mating surfaces also parallel to the output shaft and second pistons housing formed in the stationary housing, said anti-twist bearing surfaces being arranged and constructed to internally bound the complementary mating surfaces of the housing and act parallel to the anti-twist bearing surfaces, thereby providing two parallel non-coincident guiding surfaces whereby the guiding surfaces of the first pistons and the anti-twist bearing surface when taken together provide parallel non-coincident guiding surfaces for the rectilinear motion and create a linear guideway for the carriage and rotatable mass as well as prevention of rotation about the axis of the first piston assembly.

4. The expandible chamber motor of claim 1 whereby means are provided to replenish fluid in both of said hydraulic chamber means.

* * * * *